US005337586A

United States Patent [19]

Ronchi

[11] Patent Number: 5,337,586

[45] Date of Patent: Aug. 16, 1994

[54] OXIDATION INTENSIFIER FOR CONTINUOUS WARP-CHAIN INDIGO DYEING MACHINES

[75] Inventor: Francesco Ronchi, Sovico, Italy

[73] Assignee: Master S.A.S. Di Ronchi Francesco & C., Macherio, Italy

[21] Appl. No.: 946,580

[22] Filed: Sep. 18, 1992

[30] Foreign Application Priority Data

Sep. 19, 1991 [IT] Italy ..... MI91 A 002480

[51] Int. Cl.[5] ..... D06B 3/04

[52] U.S. Cl. ..... 68/5 D; 15/316.1; 34/638; 68/9; 68/19.1; 68/20; 68/22 R

[58] Field of Search ..... 68/5 D, 5 E, 9, 19.1, 68/20, 22 R; 15/309.1, 316.1; 34/155, 156

[56] References Cited

U.S. PATENT DOCUMENTS

| | | | |
|---|---|---|---|
| 1,500,298 | 7/1924 | Chase et al. | 68/9 |
| 1,562,763 | 11/1925 | Harris | 68/5 D X |
| 2,775,046 | 12/1956 | Kabelitz | 34/156 X |
| 4,085,522 | 4/1978 | Stroszynski | 34/155 X |
| 4,094,074 | 6/1978 | Schrader et al. | 34/155 X |
| 4,094,077 | 6/1978 | Schrader et al. | 34/155 |
| 4,227,317 | 10/1980 | Fleissner | 34/155 |
| 4,425,719 | 1/1984 | Klein et al. | 34/155 X |
| 4,663,863 | 5/1987 | Curry et al. | 34/155 X |

FOREIGN PATENT DOCUMENTS

| | | | |
|---|---|---|---|
| 0343925 | 11/1989 | European Pat. Off. . | |
| 1098271 | 7/1955 | France . | |
| 614339 | 11/1979 | Switzerland . | |
| 695582 | 8/1953 | United Kingdom | 68/5 D |
| 2066706 | 7/1981 | United Kingdom . | |
| WO80/00183 | 2/1980 | World Int. Prop. O. . | |

*Primary Examiner*—Philip R. Coe

*Attorney, Agent, or Firm*—Jacobson, Price, Holman & Stern

[57] ABSTRACT

An oxidation intensifier apparatus for continuous warp-chain indigo dyeing machines for dyeing a plurality of adjacent spaced parallel warp threads passing in a traveling path through a plurality of dyeing and squeezing units includes a first oxidation intensifier unit (10A) on one side of said traveling path, a second oxidation intensifier unit on the other side of said traveling path between two dyeing and squeezing units (I and II), and a fan (19) in each unit for blowing air onto opposite sides of the warp threads passing between the units. Each oxidation intensifier unit has an inlet on which the fan (19) is mounted, a diffuser (22) having an air inlet (21) adjacent the output side (20) of the fan and a diffuser outlet (23) in adjacent spaced relationship to the traveling warp threads (12). Each diffuser may contain in its interior a deflector (25) and/or a grille-type conveyor (26) to assure uniform distribution of the air delivered from the fan to the traveling warp threads. The outlet end of the diffuser (23) may have mounted thereon a perforated plate to further assure uniform distribution of air from the fan onto the warp threads. The diffuser extends over the entire width of the traveling warp threads and may be provided with a plurality of equally spaced fans across the width of the diffuser.

18 Claims, 4 Drawing Sheets

OXIDATION INTENSIFIER FOR CONTINUOUS WARP-CHAIN INDIGO DYEING MACHINES

Yarn dyeing with indigo blue dye is an old art extending back to the beginning of the 1900s, indigo (then of vegetable extraction) being the only dye which could dye blue with good resistance to washing.

The invention of the synthetic dye "bleu hydron" in the early 1900s resulted however in its rapid decline, with the result that by 1925/1930 its use had practically ceased in the main industrialized countries as the new dye had a considerably lower cost, was of greater resistance and required a much simpler method of application.

However in recent years the indigo blue dye has again become fashionable and its use is continuously increasing. This is because of its special characteristics which distinguish it from any other dye.

In this respect, fabrics obtained from yarn continuously dyed with indigo and normally used for blouses and jeans have the special characteristic of strongly fading in the rubbing regions (knees, elbows, seat etc.) and of continuously losing slight color at each wash. However, whereas the fading color becomes light blue it strongly increases in brilliance, to give the articles of clothing an appearance which is totally special and inimitable.

However, although synthetic indigo blue dye has been available for many years, its method of application has remained practically unaltered, being very laborious and complicated because of its special morphological characteristics.

In this respect, the dye, having a large molecule of poor affinity with cellulose fiber, not only has to be reduced in alkaline solution in order to be applied, but also requires several impregnations separated by dehydration plus oxidation in air. In practice, a medium or dark color tone is obtained only if the yarn is subjected to initial dyeing followed by several over-dyeings.

This method is used with all dyeing machines whether using the open-width or rope system, they consisting normally of 5–8 impregnation vats, each with its own oxidation unit, followed by 2–3 wash vats.

The construction of these machines has to reflect determined basic parameters relative to immersion and oxidation time to enable the dye to uniformly impregnate the yarn and, after squeezing, to undergo complete oxidation before entering the next vat for darkening of the color tone.

The average time recommended for perfect oxidation is about 60 seconds, i.e. after the initial dyeing/squeezing, the yarn must remain exposed to the air for 60 seconds before being reimmersed in the second dyeing vat, and so on for all the subsequent dyeing stages.

On the basis of the aforegoing, it is therefore apparent that the length of the yarn exposed to the air for dye oxidation between one dyeing stage and the next has to be equal in meters to the machine operating rate in meters per minute.

The average dyeing rate can be considered to be about 30–35 meters per minute, hence based on a machine with eight dyeing vats, the yarn involved in passing through the various oxidation units reaches a considerable length, i.e. is 35 meters×8 oxidation units=280 meters.

These 280 meters of yarn plus the much smaller amount involved in passage through the other machine components have to be considered lost at each batch change, because the dyeing is not uniform.

It is therefore apparent that if the passage lengths through the various oxidation units can be substantially reduced, with consequent reduction of the yarn length discarded at each batch, a substantial saving in operating cost would be achieved together with a reduction in the machine cost (less rollers, less supports etc.) and a reduction in the machine length, with all the resultant advantages.

BRIEF SUMMARY OF THE INVENTION

The object of the present invention is therefore to provide an oxidation intensifier which enables the length of yarn exposed to the air between one dyeing stage and the next to be reduced, to hence obtain the aforesaid advantages.

To achieve this, the yarn impregnated with dye to be oxidized must come into contact with the maximum possible quantity of oxygen and hence of air within the minimum time necessary for complete oxidation.

The aforesaid object is attained according to the present invention by an oxidation intensifier for continuous warp-chain indigo dyeing machines for denim fabric and the like, characterized by a first unit comprising at least one fan with its pressing mouth, or delivery side, i.e., the output side of a fan or the like where air is compressed and delivered under pressure, connected to the entry aperture of a diffuser, the exit aperture of which is provided with a perforated plate and extends along the entire width of the yarn web transversely to the direction of advancement of the yarn web, which is formed from all the warp yarns of the fabric, and longitudinally to said direction of advancement for a predetermined length, the first unit being positioned on one of the yarn web and being opposed by a second unit of analogous formation positioned on the opposite side of the yarn web, the distance of the two units from the yarn web being substantially equal.

An oxidation intensifier of this type is intended to be used downstream of each dyeing and squeezing unit of the machine, and by its use the air leaving the exit aperture of the diffuser of each unit not only uniformly strikes the entire width of the yarn web so as not to create oxidation disuniformity which could result in color stripes on the fabric, but also uniformly strikes the outer perimeter of each individual yarn, without the air flow disturbing the ordered arrangement of the yarn web in the case of open-width dyeing.

According to a preferred embodiment, each unit of the oxidation intensifier comprises a single tangential fan, the output side of which is directly connected to the entry aperture of the associated diffuser and has the same dimensions as the entry aperture, which extends along the entire width of the yarn web. However it is also possible to use helicoidal flow fans, in which case as these do not have a delivery mouth of sufficient size to extend along the entire width of the yarn web, each unit of the oxidation intensifier must include a plurality of fans suitably spaced apart, with their output sides connected to the entry aperture of a common diffuser to achieve the desired proper distribution of the air stream along the entire width of the yarn web.

Finally, each unit of the oxidation intensifier could use a centrifugal fan with its output side connected to a diffuser. in which case suitable deflector means are provided inside the diffuser to obtain the required air flow distribution.

Similar deflectors can also be positioned inside the diffuser if helicoidal flow fans are used.

Grille-type air conveyors can also be positioned inside the diffusers associated with helicoidal flow or centrifugal fans.

It has proved important to apply the perforated plate to the diffuser exit aperture, by which a slight pressure is created inside the diffuser to ensure uniform air distribution over the entire delivery surface.

The two opposing units of the oxidation intensifier can be positioned with their respective diffuser exit apertures directly facing each other, to create directly opposing air streams between which the yarn web passes, so that it is exposed on both sides to the air streams at the same distance and at the same pressure, so preventing vibration and disarrangement of the yarns, which could result in superposing of the yarns and ribbiness, with consequent dyeing defects.

However, the two opposing units can also be offset in the direction of advancement of the yarn web, to enable each individual yarn to be uniformly struck on its outer perimeter.

The oxidation intensifier of the invention is not only applicable to open-width dyeing machines but also to rope dyeing machines.

In this case greater oxidation uniformity between the outer and inner yarns of each rope is achieved due to the fact that the air is under a small pressure and hence penetrates more deeply within the rope, and to the increased operating rate.

BRIEF DESCRIPTION OF THE DRAWINGS

Examples of embodiments of the invention are described hereinafter by way of non-limiting example with reference to the accompanying schematic drawings wherein.

DETAILED DESCRIPTION

Figure 1:
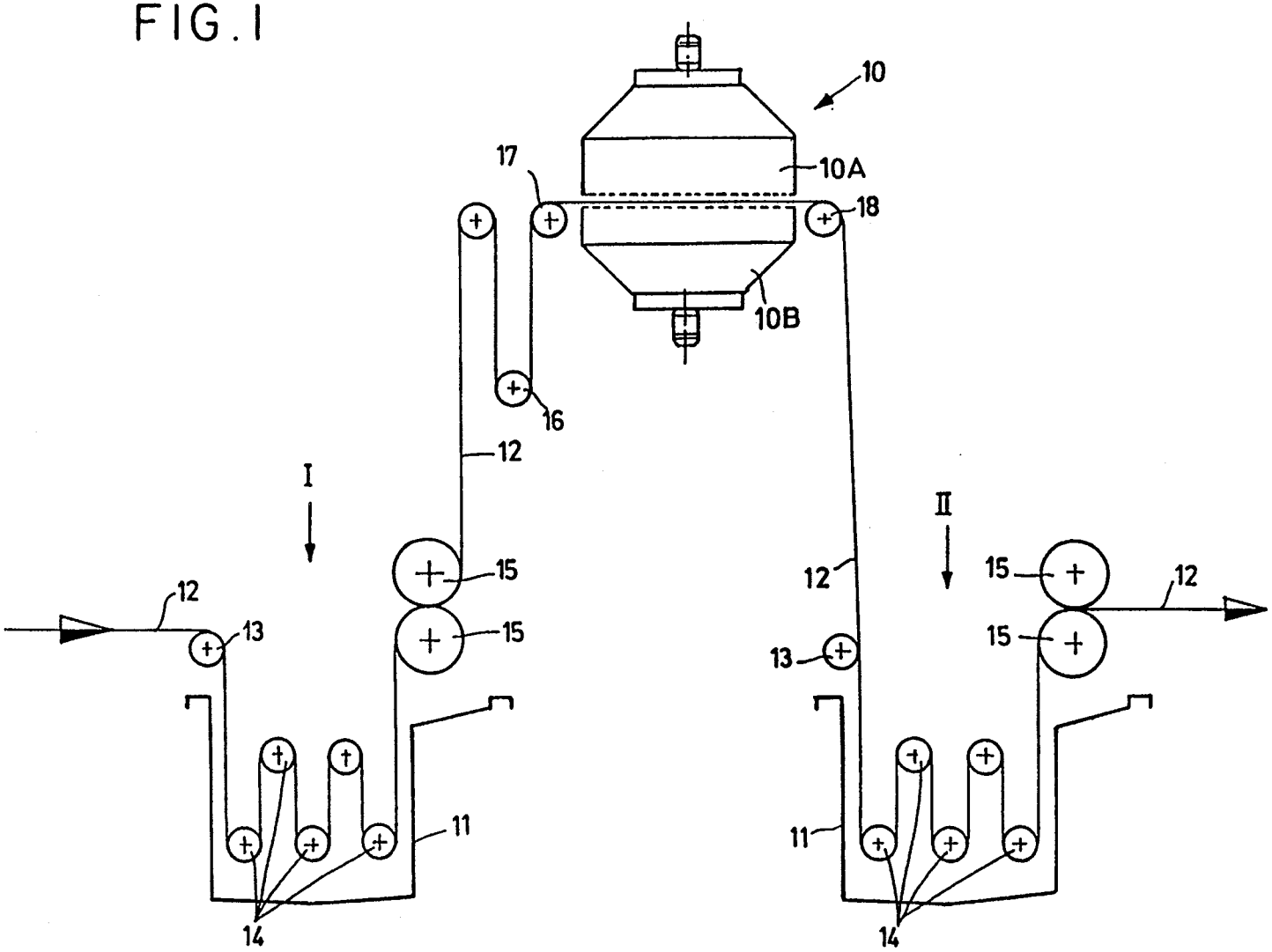
FIG. 1 is a schematic view of an oxidation intensifier positioned between two successive dyeing/squeezing units of a continuous dyeing machine.

As can be seen from the scheme of FIG. 1, the oxidation intensifier, indicated overall by 10, is positioned in the space between two dyeing/squeezing units, indicated by I and II respectively, of a continuous dyeing machine.

Each of the units I and II comprises an impregnation vat 11 in which the yarn web 12 advancing in the direction of the arrows indicated in FIG. 1 is immersed into the dyeing bath consisting of an alkaline solution of indigo dye. The yarn web reaches each vat 11 by passing over a guide roller 13, to then pass through the vat about various deviation rollers 14.

On leaving each vat 11 the yarn web 12 undergoes squeezing by passing between two rollers 15.

The oxidation of the yarn web takes place in the region between the two rollers 15 at the exit of one impregnation vat 11 and the guide roller 13 associated with the next impregnation vat.

The oxidation intensifier 10 is positioned in this region between two deviation rollers 17 and 18 after a suitable floating roller 16 for tensioning the yarn web 12.

The oxidation intensifier 10 is composed of two units 10A and 10B of substantially identical configuration, positioned equidistant from and opposing about the advancing yarn web 12. Specifically, the unit 10A is positioned above said yarn web 12 and the unit 10B is positioned below it.

Figure 3:
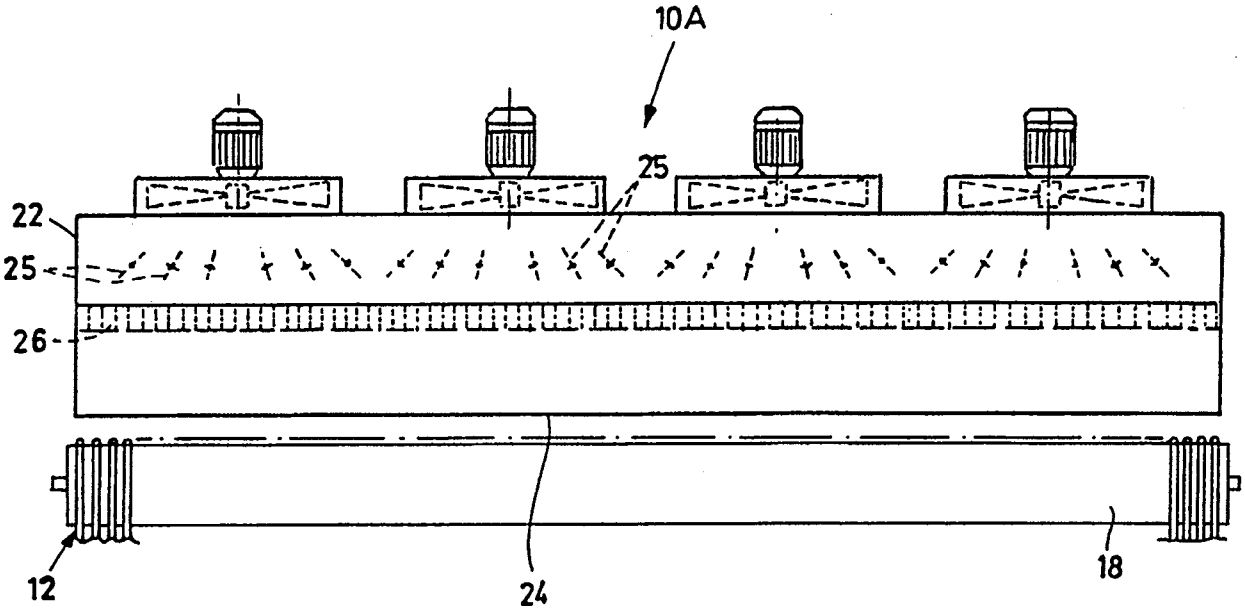
FIGS. 2 and 3 are respectively a longitudinal cross sectional view and a side elevational view of one of the units of the oxidation intensifier shown in FIG. 1.
Figure 2:
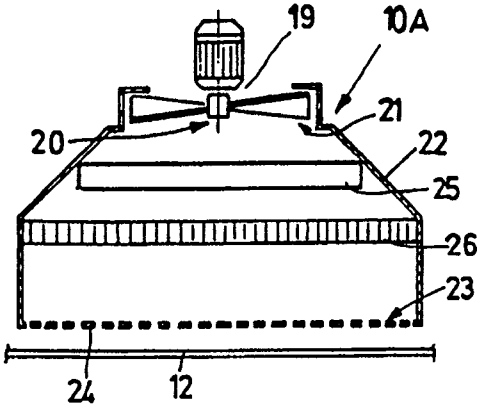

FIGS. 2 and 3 show one embodiment of the upper unit 10A of the oxidation intensifier, the relative lower unit 10B being identical to 10A but being positioned opposing it, i.e. symmetrical about the plane of passage of the yarn web 12.

In this embodiment, the unit 10A comprises four helicoidal flow fans 19 positioned equidistant in a plane transverse to the direction of advancement of the yarn web 12 (see FIG. 3).

The output sides 20 (see FIG. 2) of the four helicoidal flow fans 19 are directly connected to the entry aperture 21 of a common diffuser 22 which in length extends along the entire width of the yarn web 12 (see FIG. 3).

The air exit aperture 23 of the diffuser 22 extends, in the width direction, for a predetermined distance between the deviation rollers 17 and 18 of the yarn web 12 (see FIGS. 1 and 2) and is provided with a perforated plate 24. In this manner a slight pressure is created within the diffuser 22 to ensure uniform air distribution over the entire delivery surface below the perforated plate 24.

Figure 5:
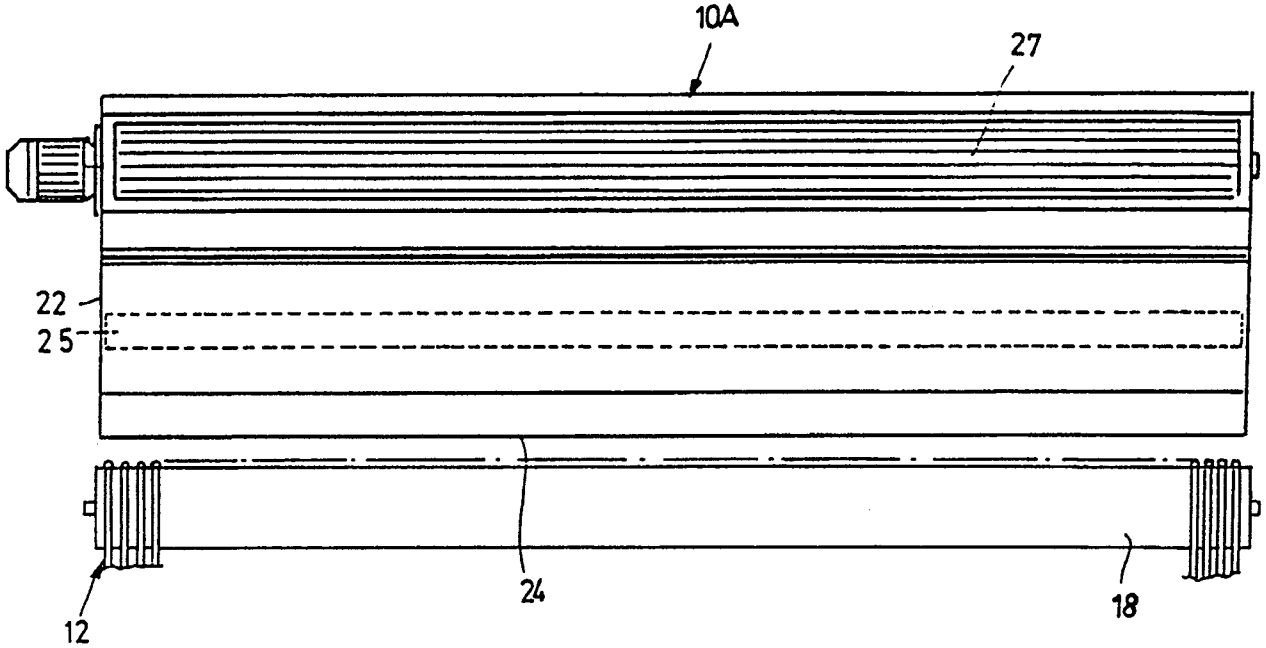
FIGS. 4 and 5 show a further embodiment in the same views as FIGS. 2 and 3.
Figure 4:
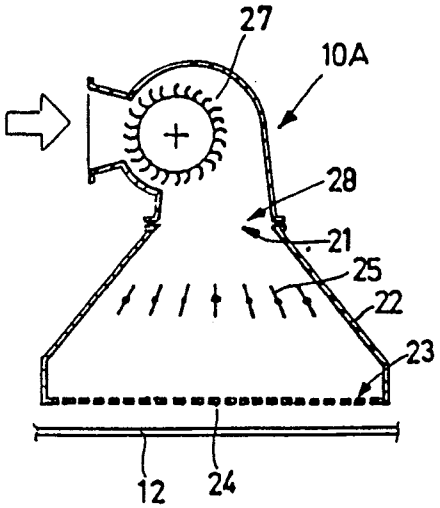

Optionally, but not necessarily, the interior of the diffuser 22 can be provided with deflectors 25, possibly of adjustable type, and a grille-type conveyor 26 to improve the distribution uniformity of the delivery air from the four helicoidal flow fans 19. According to a further embodiment, shown in FIGS. 4 and 5, a tangential fan 27 can be used in each of the units 10A and 10B of the oxidation intensifier 10 instead of the helicoidal flow fans. In this case, the output sides 28 of the tangential fan 27 extends along the entire length of the entry aperture 21 of the diffuser 22 and is connected directly to said entry aperture. The exit aperture 23 of the diffuser 22 is again fitted with a perforated plate 24, the length and width of the diffuser corresponding to the aforesaid. Again in this case, the interior of the diffuser can be provided optionally, but not necessarily, with deflectors 25.

In a further possible embodiment, the fans of the two oxidation intensifier units can be in the form of centrifugal fans, again connected to respective diffusers provided with a perforated plate at their exit aperture, in this case it being necessary to provide suitable deflectors and possibly a grille-type conveyor in the interior of each diffuser to ensure the desired and necessary uniform air distribution over the entire delivery surface.

It should be noted that in the embodiment shown in FIGS. 2 and 3, four helicoidal flow fans are indicatively provided in each unit 10A and 10B of the oxidation intensifier. However, the number of such axial flow fans depends on the one hand on their output side diameter and on the other hand on the width of the yarn web to be struck by the air stream produced by the fans and distributed by the diffuser connected to them. The number of helicoidal flow fans can therefore be smaller or greater than four, depending on requirements.

In the embodiments considered heretofore, the two constituent units of the oxidation intensifier 10 not only have the same configuration and are positioned the same distance from and symmetrical about the plane of advancement of the yarn web, but also directly oppose each other so that the perforated plates of the respective diffuser exit apertures directly face each other. In this manner the air streams leaving the delivery surfaces of the two diffusers act on the yarn web and hence on its individual constituent yarns with the same pressure and in opposite directions, one from above and the other from below, so preventing vibration and disarrangement of the yarns and possible superposing and ribbing, and hence maintaining the ordered arrangement of the yarn web intact.

Figure 6:
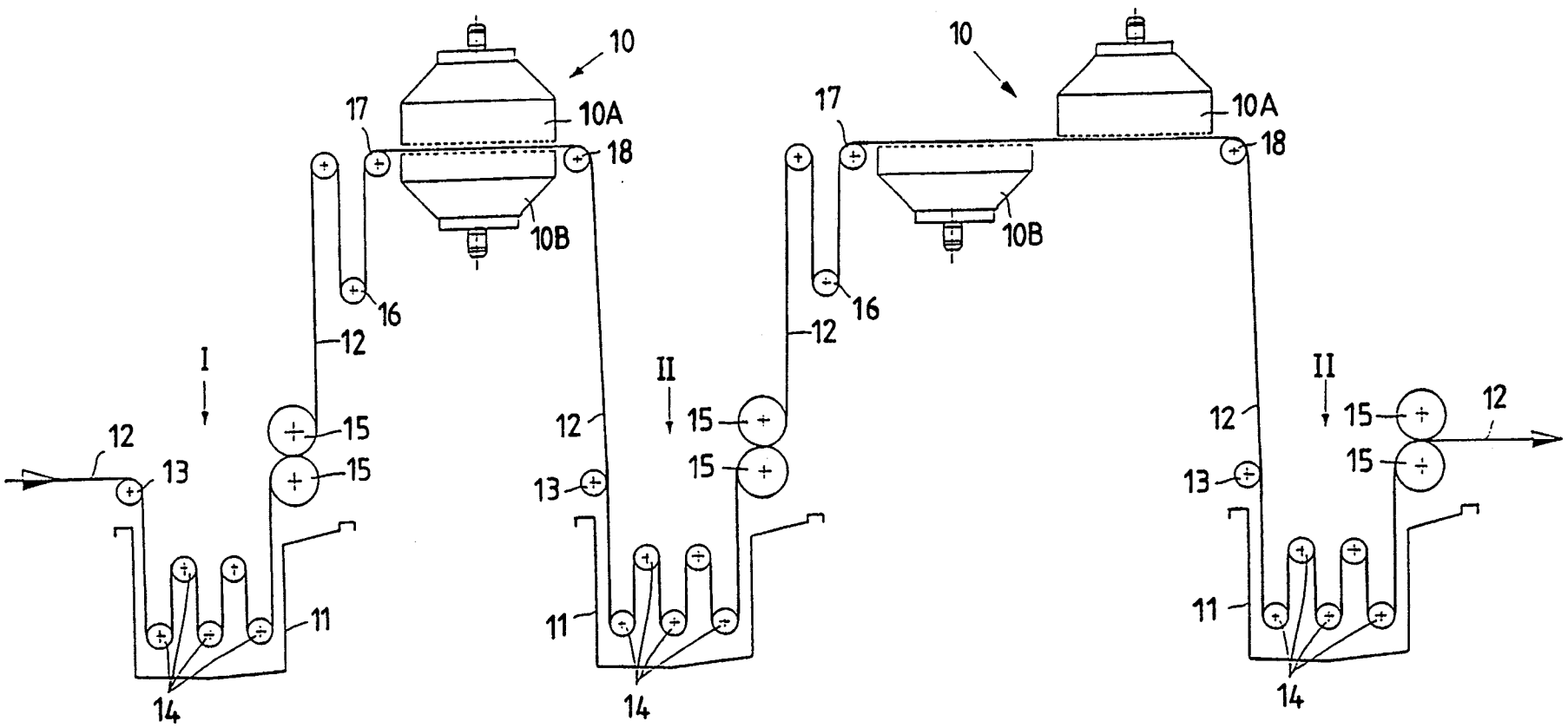
FIG. 6 is a schematic view similar to FIG. 1, showing a further embodiment of the invention.

However the two units, i.e. the upper and the lower, could be offset in the direction of advancement of the yarn web, as shown in the right hand portion of FIG. 6, so that the individual yarns are struck uniformly on their outer perimeter without substantially prejudicing the ordered arrangement of the yarn web. Although the offset embodiment is shown in FIG. 6 connected in series with the embodiment of FIG. 1, of course the offset embodiment could be separate and independent.

It has been assumed heretofore that the oxidation intensifier is applied to an open-width dyeing machine in which the yarn web is formed from a number of yarns, all parallel and advancing in the same plane, and equal to the number of warp yarns of the fabric to be produced.

However, the oxidation intensifier can also be applied to a rope-type dyeing machine, in which one or more yarn ropes are treated.

In this case the term "yarn web" means the total yarn ropes advancing in the same plane.

The advantages obtained by the oxidation intensifier according to the invention are considerable and can be summarized as follows:

Economical drastic reduction in the yarn quantity to be discarded for each batch (about 80% reduction)

machine simplification, with less rollers on the oxidation units and hence reduced cost and less operating difficulties reduced machine length and space requirement possibility of substantially increasing the operating rate (the ventilation reduces the yarn moisture, so increasing dye absorption):

Quality improved oxidation uniformity of individual yarns due to the forced passage of the air, which also strikes and oxidizes the contact regions between one yarn and another improved oxidation/dyeing uniformity and greater repeatability due to the constant uniform action of the intensifier which eliminates the random instantaneous daily or seasonal variations in the working environment due to air draughts (opening of doors, etc.), presence of fog, low pressure, or summer/winter variations increase in color tone due to improved oxidation if applied to rope dyeing machines, better oxidation uniformity is achieved between the outer and inner yarns due to the fact that the air is under a small pressure and hence penetrates more deeply within the rope.

Again in this case the operating rate can be increased, however the quantity of yarn to be discarded at the commencement of the batch is not reduced because with this system the batch change takes place continuously by tieing the end of the ropes being dyed to the beginning of the new ropes.

I claim:

1. An oxidation intensifier apparatus for continuous warp-chain indigo dyeing machines having at least two spaced dyeing and squeezing units for dyeing a plurality of adjacent spaced parallel warp threads passing in a traveling path through said at least two spaced dyeing and squeezing units, said apparatus comprising:

a first oxidation intensifier unit mounted on one side of said traveling path;

a second oxidation intensifier unit mounted on the opposite side of said traveling path from said first oxidation intensifier unit;

each oxidation intensifier unit being disposed between said at least two spaced dyeing and squeezing units and comprising:

a diffuser having a diffuser inlet and a diffuser outlet, said diffuser outlet being in spaced relationship to said traveling path of said warp threads and having a width extending the entire width of said warp threads transverse to the direction of travel of said warp threads in said traveling path and a length extending longitudinally in the direction of travel of said traveling path of said warp threads for a predetermined distance, at least one fan means having an inlet side and an outlet side, said outlet side being disposed adjacent to said diffuser inlet; and said diffuser outlets of said first and second oxidation intensifier units being spaced substantially equidistantly from said warp threads on opposite sides of said traveling path of said warp threads, so that operation of said at least one fan means of each intensifier unit draws air through said fan input side and expels air through said output side and through said diffuser inlet into and through said diffuser for uniform distribution of said air onto opposite of sides of warp threads moving in said traveling path.

2. An oxidation intensifier apparatus as claimed in claim 1 wherein:

said at least one fan means comprises a single tangential fan; and said output side of said fan means is directly connected to said diffuser inlet and has the same dimensions as said diffuser inlet having a width extending along the entire width of said warp threads in said traveling path.

3. An oxidation intensifier apparatus as claimed in claim 2 and further comprising:

air deflector means mounted inside said diffuser between said diffuser inlet and outlet for producing uniform distribution of said air passing through said diffuser from said fan.

4. The oxidation intensifier apparatus as claimed in claim 3 wherein:

said diffuser outlet of said first intensifier unit and said diffuser outlet of said second intensifier unit are directly oppositely disposed with respect to each other on opposite sides of said warp threads moving in said traveling path for providing uniform distribution of said air passing through said diffuser outlets onto the entire peripheral surfaces of said warp threads simultaneously.

5. The oxidation intensifier apparatus as claimed in claim 3 wherein:

said first and second intensifier units are mutually offset with respect to each other in the direction of travel of said warp threads in said traveling path.

6. The oxidation intensifier apparatus as claimed in claim 5 and further comprising:

perforated plate means mounted on said diffuser at said diffuser outlet for providing uniform air distribution onto said warp threads moving in said traveling path.

7. The oxidation intensifier apparatus as claimed in claim 2 and further comprising:

a grille-type conveyor means mounted inside said diffuser for producing uniform distribution of air passing through said diffuser to said diffuser outlet.

8. An oxidation intensifier apparatus as claimed in claim 1 wherein:

said fan means comprises a plurality of spaced helicoidal flow fans each having an output side; and each output side of each of said fans is connected to said diffuser inlet.

9. An oxidation intensifier apparatus as claimed in claim 8 and further comprising:

air deflector means mounted inside said diffuser between said diffuser inlet and outlet for producing uniform distribution of said air passing through said diffuser from said fans.

10. The oxidation intensifier apparatus as claimed in claim 8 and further comprising:

a grille-type conveyor means mounted inside said diffuser for producing uniform distribution of air passing through said diffuser to said diffuser outlet.

11. The oxidation intensifier apparatus as claimed in claim 10 and further comprising:

perforated plate means mounted on said diffuser at said diffuser outlet for providing uniform air distribution onto said warp threads moving in said traveling path.

12. An oxidation intensifier apparatus as claimed in claim 1 and further comprising:

air deflector means mounted inside said diffuser between said diffuser inlet and outlet for producing uniform distribution of said air passing through said diffuser from said at least one fan means.

13. The oxidation intensifier apparatus as claimed in claim 1 and further comprising:

a grille-type conveyor means mounted inside said diffuser for producing uniform distribution of air passing through said diffuser to said diffuser outlet.

14. The oxidation intensifier apparatus as claimed in claim 1 wherein:

said diffuser outlet of said first intensifier unit and said diffuser outlet of said second intensifier unit are directly oppositely disposed with respect to each other on opposite sides of said warp threads moving in said traveling path for providing uniform distribution of said air passing through said diffuser outlets onto the entire peripheral surfaces of said warp threads simultaneously.

15. The oxidation intensifier apparatus as claimed in claim 14 and further comprising:

perforated plate means mounted on said diffuser at said diffuser outlet for providing uniform air distribution onto said warp threads moving in said traveling path.

16. The oxidation intensifier apparatus as claimed in claim 1 and further comprising:

perforated plate means mounted on said diffuser at said diffuser outlet for providing uniform air distribution onto said warp threads moving in said traveling path.

17. The oxidation intensifier apparatus as claimed in claim 1 wherein:

said first and second intensifier units are mutually offset with respect to each other in the direction of travel of said warp threads in said traveling path.

18. The oxidation intensifier apparatus as claimed in claim 17 and further comprising:

perforated plate means mounted on said diffuser at said diffuser outlet for providing uniform air distribution onto said warp threads moving in said traveling path.

* * * * *